United States Patent [19]

Yoshida et al.

[11] Patent Number: 4,829,948

[45] Date of Patent: May 16, 1989

[54] VALVE OPERATING DEVICE FOR INTERNAL COMBUSTION ENGINE

[75] Inventors: Kazuo Yoshida; Kenji Hirose; Toshiyasu Komatsu, all of Tokyo; Kazuaki Shimoyama; Yoshihito Tsuji, both of Saitama, all of Japan

[73] Assignee: Honda Giken Kogyo Kabushiki Kaisha, Tokyo, Japan

[21] Appl. No.: 137,758

[22] Filed: Dec. 24, 1987

[30] Foreign Application Priority Data

Dec. 27, 1986 [JP] Japan ..... 61-311627
Dec. 27, 1986 [JP] Japan ..... 61-311628

[51] Int. Cl.[4] ..... F01L 1/34

[52] U.S. Cl. ..... 123/90.16; 123/90.33; 123/90.44

[58] Field of Search ..... 123/90.16, 90.17, 90.27, 123/90.33, 90.34, 90.36, 90.39, 90.43, 90.44, 90.46, 198 F

[56] References Cited

U.S. PATENT DOCUMENTS 4,523,550 6/1985 Matsuura ..... 123/90.16
4,535,732 8/1985 Nakano et al. ..... 123/90.16
4,545,342 10/1985 Nakano et al. ..... 123/198 F
4,646,690 3/1987 Hayashi ..... 123/90.46
4,656,977 4/1987 Nagahiro et al. ..... 123/90.16
4,699,094 10/1987 Stegeman ..... 123/90.46

*Primary Examiner*—Willis R. Wolfe
*Attorney, Agent, or Firm*—Lyon & Lyon

[57] ABSTRACT

A valve operating device for the intake or exhaust valves of an internal combustion engine wherein a plurality of cam followers are disposed adjacent to each other for operation by different cams in mutually different modes dependent on the speed of rotation of a camshaft. A selective coupling mechanism disposed in and between the cam followers has switching pins movable between a connecting position in which the cam followers are interconnected and a disconnecting position in which the cam followers are disconnected. An oil passage is provided in one or more of the cam followers and the switching pin therein is arranged to control the rate of flow of oil through the oil passage defined in that cam follower in response to movement of the switching pin between the connecting and disconnecting positions. The oil supplied through the oil passage is used for lubricating the cam and cam following sliding surfaces in one embodiment and for operating hydraulic valve lash adjusters in another embodiment.

19 Claims, 4 Drawing Sheets

FIG. 8.
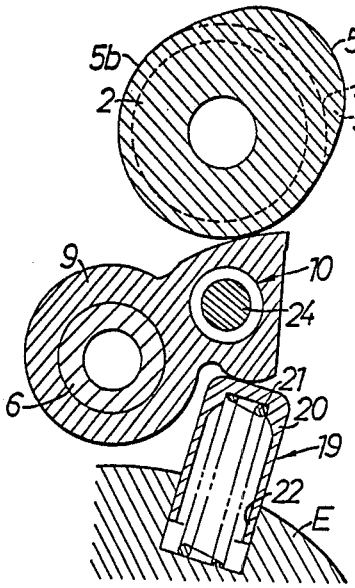
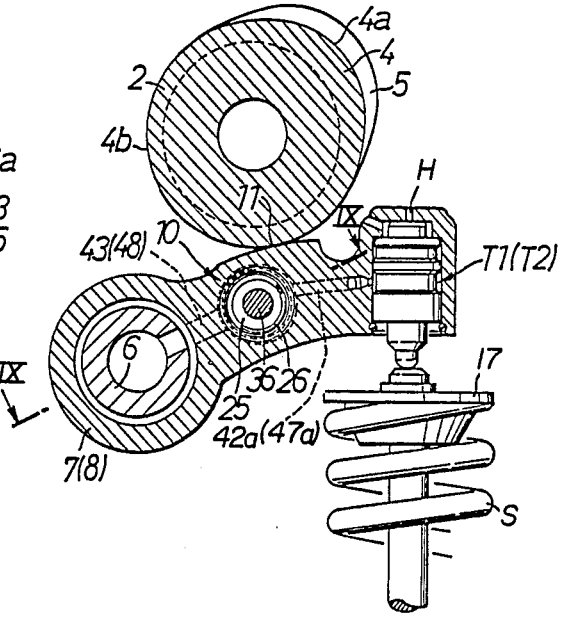
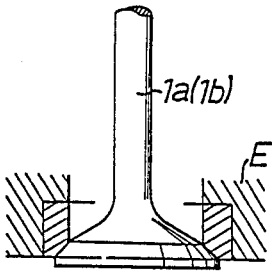
FIG. 6.
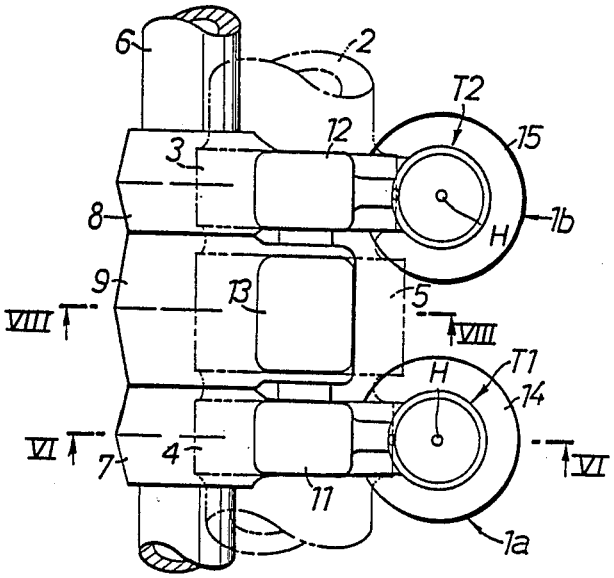
FIG. 7.

VALVE OPERATING DEVICE FOR INTERNAL COMBUSTION ENGINE

The present invention relates to a valve operating device for an internal combustion engine of the type having a plurality of cam followers disposed adjacent to each other for operating the intake or exhaust valves in different modes dependent on engine speed by means of a selective coupling mechanism for connecting and disconnecting the cam followers and, in particular, to an arrangement for controlling oil flow through a passage in a cam follower by means of the coupling mechanism.

Heretofore, valve operating devices of this general type have been known, for example, as disclosed in U.S. Pat. Nos. 4,537,164, 4,537,165, 4,5453342, 4,536,732, 4,656,927, 4,612,884, 4,526,128 and 4,587,936 owned by the assignee of this application.

In the valve operating mechanism, the cam followers may have oil passages for supplying lubricating oil to the surfaces of the cam followers which are slidably held against the camshaft or for supplying oil to the hydraulic lash adjusters. It is desirable that the amount of lubricating oil supplied be controlled according to the operating conditions of the engine. If the control of the amount of supplied lubricating oil, and/or hydraulic lash adjuster oil can be, accomplished by the selective coupling mechanism, then no special control device is necessary for such control, and hence the number of parts required and the cost of manufacture can be reduced.

It is an object of the present invention to provide a valve operating device for an internal combustion engine, which includes a selective coupling mechanism having a switching pin capable of controlling the amount of flow of oil in an oil passage defined in the cam follower.

Two embodiments of the present invention will hereinafter be described with reference to the drawings, wherein:

FIG. 6 is a vertical cross-sectional view of a second embodiment of this invention taken substantially on the line VI—VI in FIG. 7.

FIG. 7 is a plan view of the second embodiment illustrated in FIG. 6.

FIG. 8 is a vertical cross-sectional view taken on the line VIII—VIII in FIG. 7.

Figure 1:
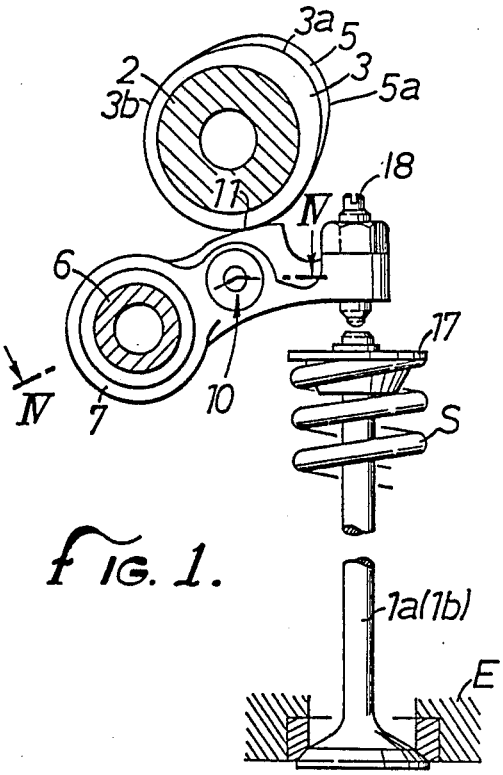
FIG. 1 is a vertical cross-sectional view of a first embodiment of the valve operating mechanism of this invention taken substantial on the line I—I in FIG. 2.
Figure 2:
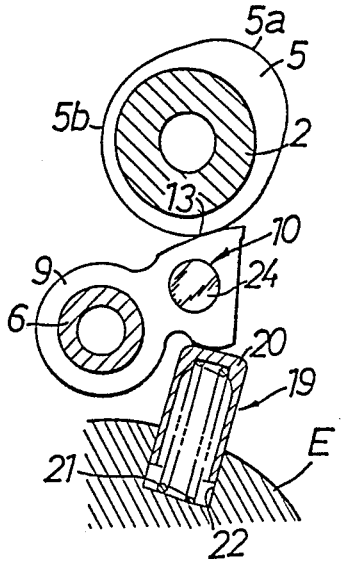
FIG. 2 is a plan view of the first embodiment shown in FIG. 1.

As shown in FIGS. 1 and 2, a part of intake valves 1*a*, 1*b* disposed in a engine body E is opened and closed by two low-speed cams 3 and one high-speed cam 5 which are integrally formed on a camshaft 2 rotatable by the crankshaft of the engine at a speed ratio of ½ the speed of rotation of the crankshaft, by first, second, and third rocker arms 7,8,9, pivotally supported on a rocker shaft 6 extending parallel to the camshaft 2. A selective coupling mechanism 10 is provided in the rocker arms 7 through 9 for selectively connecting and disconnecting the rocker arms.

The camshaft 2 is rotatably disposed above the engine body E. The two low-speed cams 3 are integrally formed with the camshaft 2 in alignment with the intake valves 1*a*, 1*b*, respectively. The high-speed cam 5 is integrally formed with the camshaft 2 in an intermediate position between the low-speed cams 3. Each of the low-speed cams 3 has a cam lobe 3*a* projecting radially outwardly to a relatively small extent and a base circle portion 3*b*. The high-speed cam 5 has a base circle portion 5*b* and a cam lobe 5*a* projecting radially outwardly to an extent larger than that of the cam lobe 3*a* and having a larger angular extent than that of the cam lobe 3*a*.

The rocker shaft 6 is fixed below the camshaft 2. The first rocker arm 7 is operatively associated with the intake valve 1*a*, the second rocker arm 8, is operatively associated with the intake valve 1*b*, and the third rocker arm 9 is disposed between the first and second rocker arms 7,8, and all three rocker arms are pivotally supported on the rocker shaft 6 in mutually adjacent relation to each other. The first rocker arm 7 has on its upper surface a cam slipper 11 held in slidable contact with the low-speed cam 3. The second rocker arm 8 has on its upper surface a cam slipper 12 held in slidable contact with the low-speed cam 3. The third rocker arm 9 has on its upper surface a cam slipper 13 held in slidable contact with the high- o speed cam 5. Thus, the rocker arms 7,8,9 serve as cam followers. The rocker arms 7 through 9 have ejector holes 14*a*, 14*b*; 15*a*, 15*b*; 16*a*, 16*b* defined in the cam slippers 11 through 13 respectively, and opening on opposite sides of their surfaces slidably held against the cams 3, 5 for supplying lubricating oil to these sliding surfaces.

Flanges 17 are attached to the upper ends of the intake valves 1*a*, 1*b*. The intake valves 1*a*, 1*b* are normally urged in a closing direction, i.e., upwardly, by valve springs S disposed between the flanges 17 and the engine body E. Tappet screws 18 are adjustable threaded in the distal ends of the first and second rocker arcs 7, 8, respectively, and held against the upper ends of the intake valves 1*a*, 1*b*, respectively.

Figure 3:
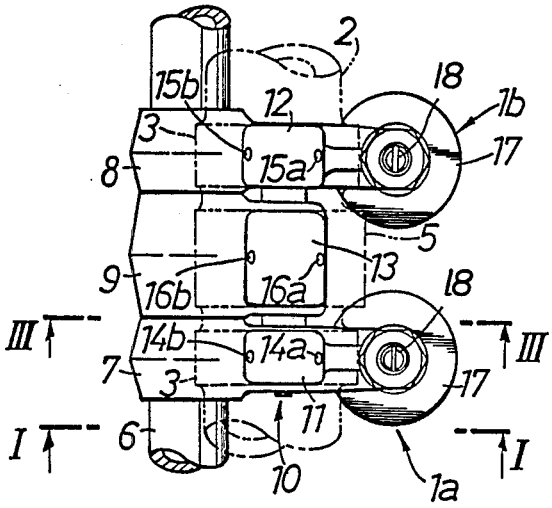
FIG. 3 is a vertical cross-sectional view taken substantially on the line III—III in FIG. 2.

As also shown in FIG. 3, the third rocker arm 9 extends from the rocker shaft 6 toward a position between the intake valves 1*a*, 1*b*. The third rocker 9 is normally urged resiliently in a direction to slidably contact the high-speed cam 5 by resilient urging means 19 disposed between the third rocker arm 9 and the engine body E. The resilient urging means 19 comprises a cylindrical bottomed lifter 20 with its closed end held against the third rocker arm 9, and a lifter spring 21 disposed between the lifter 20 and the engine body E. The lifter 20 is slidably fitted in a bottomed hole 22 defined in the engine body E.

Figure 4:
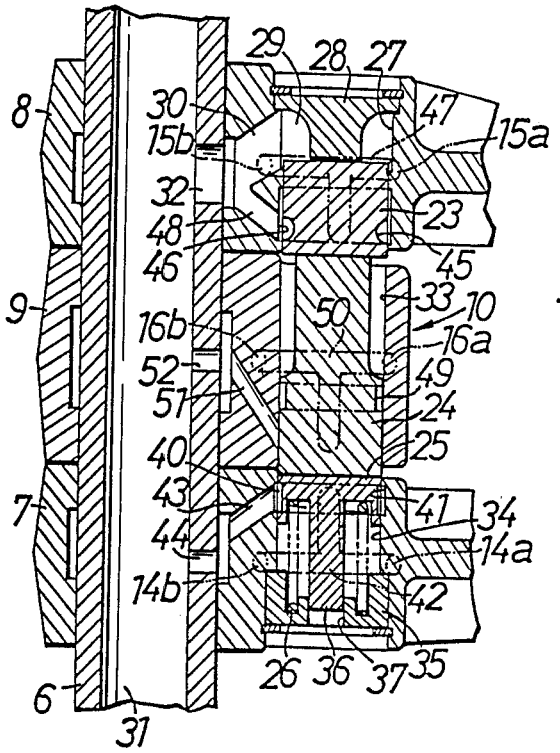
FIG. 4 is a cross-sectional view taken substantially on the line IV—IV in FIG. 1 and illustrating the coupling mechanism in the disconnected condition.

As illustrated in FIG. 4, the selective coupling mechanism 10 for connecting and disconnecting the rocker arms 7 through 9 are disposed in and between these rocker arms 7 through 9. The selective coupling mechanism 10 comprises a first switching pin 23 capable of coupling the second and third rocker arms 8, 9 to each other, a second switching pin 24 capable of coupling the third and first rocker arms 9, 7 to each other, a third switching pin 25 for limiting movement of the first and second switching pins 23, 24, and a return spring 26 for urging the switching pins 23 through 25 in a direction to disconnect the rocker arms.

The second rocker arm 8 has a first guide hole 27 parallel to the rocker shaft 6 and having an end closed by a closure member 28 remote from the third rocker arm 9. The first switching pin 23 is slidably fitted in the first guide hole 27, with a hydraulic chamber 29 being defined between the closure member 28 and the first switching pin 23. The second rocker arm 8 also has a communication passage 30 defined therein in communication with the hydraulic chamber 29. The rocker shaft 6 has an oil pressure supply passage 31 defined herein and connected to an oil pressure supply source (not shown). The communication passage 30 and the oil pressure supply passage 31 are in communication with each other at all times through a communication hole 32 defined in a side wall of the rocker shaft 6, irrespective of the angular position of the second rocker arm 8.

The third rocker arm 9 has a second guide hole 33 extending between its opposite surfaces parallel to the rocker shaft 6 in registration with the first guide hole 27, and the second guide hole 33 has the same diameter as has the first guide hole 27. The second switching pin 24 has a length equal to the entire length of the second guide hole 33 and is slidably fitted therein.

The first rocker arm 7 has a third guide hole 34 extending parallel to the rocker shaft 6 in registration with the second guide hole 33, and the third guide hole 34 has the same diameter as the second guide hole 33. The end of the third guide hole 34 remote from the third rocker arm 9 is closed by a closure member 35. The third switching pin 25 is slidably fitted in the third guide hole 34 and has a coaxial shaft 36 movably inserted through a guide hole 37 defined in the closure member 35. The return spring 26 is disposed around the shaft 36 between the closure member 35 and the third switching pin 25 for normally urging the abutting switching pins 23 through 25 in the direction to disconnect the rocker arms, i.e., toward the hydraulic chamber 29.

Figure 5:
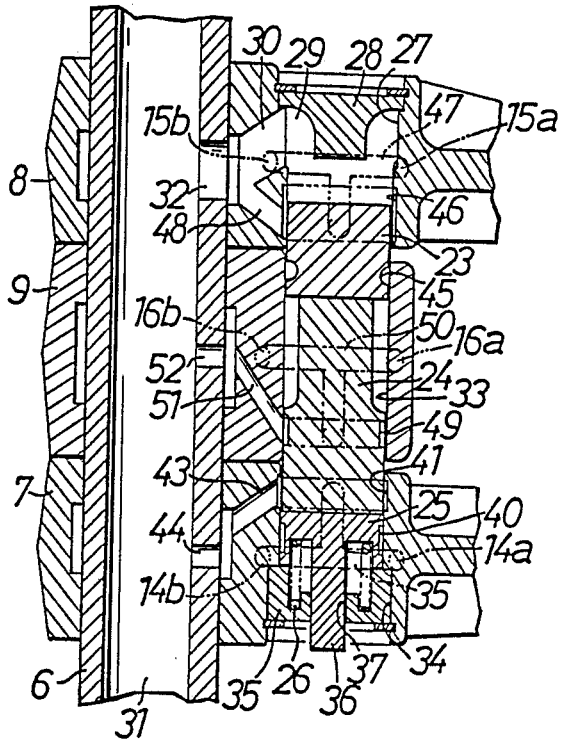
FIG. 5 is a cross-sectional view similar to FIG. 4 but illustrating the coupling mechanism in a connected condition.
Figure 9:
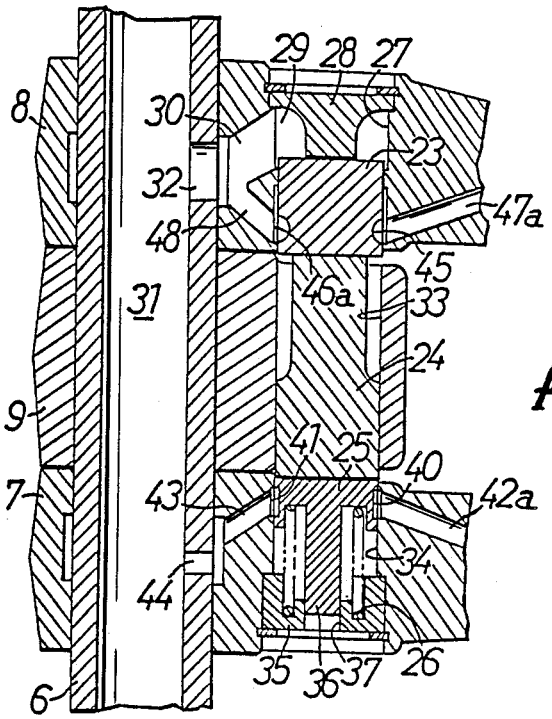
FIG. 9 is a cross-sectional view taken substantially on the line IX—IX in FIG. 6 and illustrating the coupling mechanism in the disconnected condition.
Figure 10:
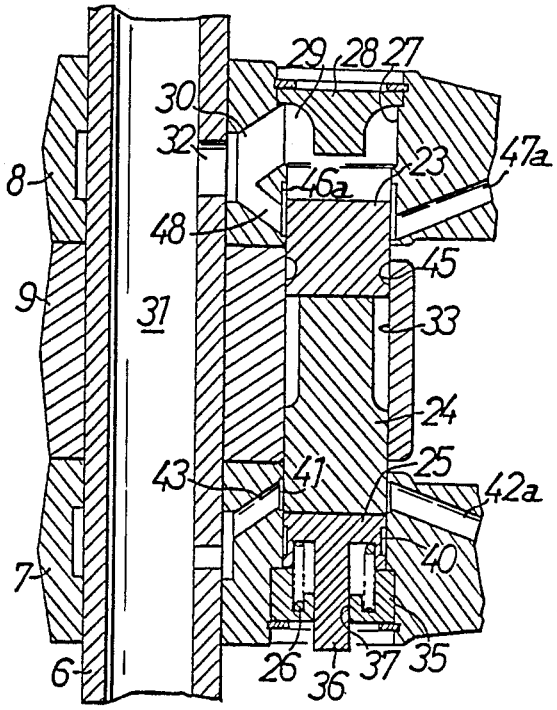
FIG. 10 is a cross-sectional view similar to FIG. 9 but illustrating the coupling mechanism in the connected condition.

With no high oil pressure supplied to the hydraulic chamber 29, the switching pins 23 through 25 are in the position shown in FIG. 4 where the rocker arms are disconnected under the bias of the return spring 26. In this position, the abutting surfaces of the first and second switching pins 23, 24 lie between the second and third rocker arms 8, 9, and the abutting surfaces of the second and third switching pins 24, 24 lie between the third and first rocker arms 9, 7, whereby the rocker arms 7 through 9 are disconnected from each other. When high oil pressure is supplied to the hydraulic chamber 29, the switching pins 23 through 25 are moved in direction away from the hydraulic chamber 29 against the force of the return spring 26 until the first switching pin 23 is slidably inserted into the second guider hole 33, and the second switching pin 24 is slidably inserted into the third guide hold 34 for thereby connecting the rocker arms 7 through 9, as shown in FIG. 5.

The third switching pin 25 has an annular groove 40 defined in its outer peripheral surface. The inner peripheral surface of the first rocker arm 7 which defines the third guide hold 34 has an annular recess 41 defined therein. The annular recess 41 is held in registry with the annular groove 40 when the third switching pin 25 is in the position to disconnect the rocker arms. The widths of the annular groove 40 and the annular recess 41 along the axis of the third switching pin 25 are selected such that when the third switching pin 25 is moved from the rocker arm disconnecting position to the rocker arm connecting position, the annular groove 40 and the annular recess 41 are positionally displaced from each other. The first rocker arm 7 has an oil passage 42 defined therein with one end communicating with the ejector holes 14*a*, 14*b* and the other end communicating with the annular recess 41. Another oil passage 43 in first rocker arm 7 has one end communicating with the annular recess 41 and the other end communicating, at all times, with the oil pressure supply passage 31 through a communication hole 44 defined in the side wall of the rocker shaft 6. Therefore, the oil passageway formed by the oil passages 42, 43 is open in the rocker arm disconnecting position of the coupling mechanism 10 but is restricted when the third switching pin 25 is moved into the rocker arm connecting position.

The first switching pin 23 has an annular groove 45 defined in its outer peripheral surface. The inner peripheral surface of the second rocker arm 8 which defines the first guide hole 27 has an annular recess 46 defined therein. The annular recess 46 is held in registry with the annular groove 45 when the first switching pin 23 is in the position to disconnect the rocker arms. The widths of the annular groove 45 and the annular recess 46 along the axis of the first switching pin 23 ar selected such that when the first switching pin 23 is moved from the rocker arm disconnecting position to the rocker arm connecting position, the annular groove 45 and the annular recess 46 are positionally displaced from each other. The second rocker arm 8 has an oil passage 47 defined therein with one end communicating with the ejector holes 15*a*, 15*b* and the other end communicating with the annular recess 46. Another oil passage 48 in the second rocker arm 8 has one end communicating with the communication hole 30. Therefore, the oil passageway formed by the oil passages 47, 48 is open in the rocker arm disconnecting position but is restricted when the first switching pin 23 in moved into the rocker arm connecting position.

An annular groove 49 is defined in the outer peripheral surface of the second switching pin 24. The third rocker arm 9 has an oil passage 50 defined therein with one end opening at the inner peripheral surface of the second guide hole 33 so that the oil passage 50 will communicate with the annular groove 49 when the second switching pin 24 is in the rocker arm connecting position. The other end of the oil passage 50 communicate with the ejector holes 16*a*, 16*b*. The third rocker arm 9 also has an oil passage 51 defined therein with one end opening at the inner peripheral surface of the second guide hole 33 so that the oil passage 51 will communicate with the annular groove 49 when the second switching pin 24 is in the rocker arm connecting position. The other end of oil passage 51 always communicates with the oil pressure supply passage 31 through a communication hole 52 defined in the side wall of the rocker shaft 6.

Operation of the valve operating device is as follows. During low-speed operation of the engine, the hydraulic chamber 29 is supplied with a relatively low oil pressure, and the switching pins 23 through 25 are positioned at the maximum stroke toward the hydraulic chamber 29, i.e., into the rocker arm disconnecting position, under the force of the return spring 26. In this position, the abutting surfaces of the first and second switching pins 23, 24 lie between the second and third rocker arms 8, 9, and the abutting surfaces of the second and third switching pins 24,25 lie between the third and first rocker arms 9, 7. Therefore, the rocker arms 7 through 9 are angularly displaceable with respect to each other.

While the rocker arms 7 through 9 are thus disconnected, the first and second rocker arms 7, 8 are angularly moved in sliding contact with the respective low-speed cams 3 in response to rotation of the camshaft 2. Therefore, the intake valves 1*a*, 1*b* are opened and closed at the timing and lift according to the profile of the low-speed cams 3. At this time, the third rocker arm 9 is angularly moved in sliding contact with the high-speed cam 5, but such angular movement does not affect operation of the first and second rocker arms 7, 8 in any way.

In the rocker arm disconnecting position, the annular groove 40 and the annular recess 41, and the annular groove 45 and the annular recess 46 are registered with each other, and the relatively low oil pressure from the oil pressure supply passage 31 is supplied via the oil passages 42, 43, and 47, 48 to the ejector holes 14*a*, 14*b* and 15*a*, 15*b* without being restricted.

During high-speed operation of the engine, a relatively high oil pressure is supplied to the hydraulic chamber 29. As shown in FIG. 5, the switching pins 23 through 25 are moved into a position to connect the rocker arms against the spring bias of the return spring 26 for thereby inserting the first switching pin 23 slidably into the second guide hole 33 and inserting the second switching pin 24 slidably into the third guide hole 34. The rocker arms 7 through 9 are thus interconnected. At this time, since the third rocker arm 9 slidingly contacting the high-speed cam 5 swings to the maximum extent, the first and second rocker arms 7, 8 swing in unison with the third rocker arm 9, and hence the intake valves 1*a*, 1*b* are opened and closed at the timing and lift according to the profile of the high-speed cam 5.

When the selective coupling mechanism 10 is thus operated to connect the rocker arms, the oil passageways formed the oil passages 42, 43 and the oil passages 47, 48 are restricted by the first and third switching pins 23, 25. Therefore, only a small amount of lubricating oil is supplied to the sliding surfaces of the low-speed cams 3 and the cam slippers 11, 12. With the second switching pin 42 moved to the rocker arm connecting position, the oil passages 50, 51 communicate with each other through the annular groove 49 whereupon lubricating oil from the oil supply passage 31 is supplied to the ejector holes 16*a*, 16*b* for lubricating the sliding surfaces of the high-speed cam 5 and the cam slipper 13.

Thus, when the engine operates in a low-speed range, a relatively large amount of lubricating oil is supplied between the low-speed cams 3 and the cam slippers 11, 12 which are subjected to a relatively large load during sliding movement. When the engine operates in a high-speed range, a relatively large amount of lubricating oil is supplied between the high speed cam 5 and the cam slipper 13 which are subjected to a relatively large load during sliding movement. Consequently, the necessary amount of lubricating oil to be supplied to the above sliding surfaces can be minimized dependent on the operating conditions of the engine. Therefore, the pump which is required to feed the lubricating oil can be smaller in size and the power expended for circulating the oil can be lowered. Such lubricating oil flow control can be performed by the selective coupling mechanism 10 without providing any special control device.

While the present invention has been described as being applied to intake valves, the invention is also applicable to a valve operating mechanism for exhaust valves. Further, although the low-speed cams 3 have been described as each having a cam lobe 3*a* of a profile to lift the respective valves 1*a*, and 1*b*, it is also possible to provide one cam 3 with only a base circle 3*b* so that it does not cause lifting of the associated valve during low speed operation or even provide one cam 3 with a slightly different cam lobe 3*a* than the other cam 3 for different operation of the two valves at low-speed.

With the present invention, as described above, with respect to the first embodiment, a switching pin is arranged to control the rate of flow of oil in an oil passage defined in at least one o the cam followers in response to movement of the switching pin between cam follower connecting and disconnecting position. Therefore, the rate of flow of oil passage can be controlled in response to movement of the switching pin of the selective coupling mechanism. No special control device for effecting such oil flow control is required. Therefore the number of parts and the cost of manufacture are reduced.

Referring now to the second embodiment of the present invention shown in FIGS. 6–10, those elements which are substantially the same as the first embodiment will be numbered the same and may not be described again in detail. For example, the cams rotate to pivot the rocker arms and actuate the valves in the same manner and the coupling mechanism 10 functions in the same manner to connect or disconnect the rocker arms 7, 8 and 9. As shown in FIGS. 6 and 8, for purposes of this embodiment, one of the low speed cams 3 is depicted as a base-circle raised portion without a cam lobe whereas the other low-speed cam 4 has a cam lobe 4*a* suitable for low-speed engine operation. The first rocker arm 7 has on its upper surface a cam slipper 11 held in slidable contact with the low-speed cam 4. The second rocker arm 8 has on its upper surface a cam slipper 12 held in slidable contact with the raised portion 3. The third rocker arm 9 has on its upper surface a cam slipper 13 held in slidable contact with the high-speed cam 5.

Flanges 17 are attached to the upper ends of the intake valves 1*a*, 1*b*. The intake valves 1*a*, 1*b* are normally urged in a closing direction, i.e., upwardly, by valve springs S disclosed between the flanges 14, 15 and the engine body E. Hydraulic lash adjusters T1, T2 having discharge holes H defined in the upper eends thereof are disposed in the distal ends of the first and second rocker arms 7, 8 respectively. The first and second rocker arms 7, 8 are held against the intake valves 1*a*, 1*b* through the respective hydraulic lash adjusters T1, T2.

As described with respect to the first embodiment, the coupling mechanism 10 functions to connect the rocker arms 8, 9 for high speed operation and disconnect the rocker arms for low-speed operation. With no high oil pressure supplied to the hydraulic chamber 29, for low-speed operation the switching pins 23 through 25 are in the position where the rocker arms are disconnected under the bias of the return spring 26. In this position, the abutting surfaces of the first and second switching pins 23, 24 lie between the second and third rocker arms 8, 9, and the abutting surfaces of the second and third switching pins 24,25 lie between the third and first rocker arms 9, 7, with the rocker arms 7 through 9 being disconnected from each other. When high oil pressure is supplied to the hydraulic chamber 29 for high-speed operation of the engine, the switching pins 23 through 25 are moved in a direction away from the hydraulic chamber 29 against the force of the return spring 26 until the first switching pin 23 in slidably inserted into the second guide hole 33, and the second switching pin 24 is slidably inserted into the third guide hole 34 for thereby connecting the rocker arms 7 through 9.

The third switching pin 25 has an annular groove 40 defined in its outer peripheral surface. The inner peripheral surface of the first rocker arm 7 which defines the third guide hole 34 has an annular recess 41 defined therein. The annular recess 41 is held in registry with the annular groove 40 when the third switching pin 25 is in the position to disconnect the rocker arms. The widths of the annular groove 40 and the annular recess 41 along the axis of the third switching pin 25 are selected such that when the third switching pin 25 is moved from the rocker arm disconnecting position to the rocker arm connecting position, the annular groove 40 and the annular recess 41 are positionally displaced from each other. The first rocker arm 7 has an oil passage 42*a* defined therein with one end communicating with the hydraulic lash adjuster T1 and the other end communicating with the annular recess 41 and another oil passage 43 with one end communicating with the annular recess 41 and the other end communicating, at all times, with the oil pressure supply passage 31 through a communication hole 44 defined in the side wall of the rocker shaft 6. Therefore, the oil passageway formed by the oil passages 42, 43 is open in the rocker arm disconnecting position but is restricted when the third switching pin 25 is moved into the rocker arm connecting position.

The first switching pin 23 has an annular groove 45 defined in its outer peripheral surface. The inner peripheral surface of the second rocker arm 8 which defines the first guide hole 27 has an annular recess 46*a*, defined therein. The annular recess 46*a* is held in registry with the annular groove 45 when the first switching pin 23 is in the position to disconnect the rocker arms. The widths of the annular groove 45 and the annular recess 46*a* along the axis of the first switching pin 23 are selected such that when the first switching pin 23 is moved from the rocker arm disconnecting position to the rocker arm connecting position, the annular groove 45 and the annular recess 46*a* are positionally displaced from each other. The second rocker arm 8 has an oil passage 47*a* defined therein with one end communicating with the hydraulic lash adjuster T2 and the other end communicating with the annular recess 46*a*, and another oil passage 48 with one end communicating with the annular recess 46*a* and the other end communicating with the communication hole 30. Therefore, the oil passageway formed by the oil passages 47*a*, 48 is open in the rocker arm disconnecting position but restricted when the first switching pin 23 is moved into the rocker arm connecting position.

Operation of the valve operating device is as follows. During low-speed operation of the engine, the hydraulic chamber 29 is supplied with a relatively low oil pressure, and the switching pins 23 through 25 are positioned in the maximum stroke toward the hydraulic chamber 29, i.e., into the rocker arm disconnecting position, under the force of the return spring 26. In this position, the abutting surfaces of the first and second switching pins 23, 24 lie between the second and third rocker arms 8, 9, and the abutting surfaces of the second and third switching pins 24, 25 lie between the third and first rocker arms 9, 7. Therefore, the rocker arms 7 through 9 are angularly displaceable with respect to each other.

While the rocker arms 7 through 9 are thus disconnected, the first rocker arm 7 is angularly moved in sliding contact with the low-speed cam 4 in response to rotation of the camshaft 2, whereas the second rocker arm 8 is held at rest in sliding contact with the circular raised portion 8. Therefore, the intake valve 1*a* is opened and closed at the timing and lift according to the profile of the low-speed cam 4, and the other intake valve 1*b* remains closed. At this time, the third rocker arm 9 is angularly moved in sliding contact with the high-speed cam 5, but such angular movement does not affect operation of the first and second rocker arms 7, 8 in any way.

In the rocker arm disconnecting position, the annular groove 40 nd the annular recess 41, and the annular groove 45 and the annular recess 46*a* are registered with each other and the relatively low oil pressure from the oil pressure supply passage 31 is supplied via the oil passages 42*a*, 43, and 47*a*, 48 to the hydraulic lash adjusters T1, T2 without being restricted.

During high-speed operation of the engine, a relatively high oil pressure is supplied to the hydraulic chamber 29. As shown in FIG. 5, the switching pins 23 through 25 are moved into a position to connect the rocker arms against the spring bias of the return spring 26 for thereby inserting the first switching pin 23 slidably into the second guide hole 33 and inserting the second switching pin 24 slidably into the third guide hole 34. The rocker arms 7 through 9 are thus interconnected. At this time, since the third rocker arm 9 slidingly contacting the high-speed cam 5 swings to the maximum extent, the first and second rocker arms 7, 8 swing in unison with the third rocker arm 9, and hence the intake valves 1*a*, 1*b* are opened and closed at the timing and lift according to the profile of the high-speed cam 5.

When the selective coupling mechanism 10 is thus operated to connect the rocker arms, the oil passageways between the oil passages 42*a*, 43 and the oil passages 47*a*, 48 are restricted by the first and third switching pins 23, 25. Oil is discharged from the discharge holes H of the hydraulic lash adjusters T1, T2. Therefore, under the condition in which the flowing amount of oil discharge from the discharge holes H and the flowing amount of oil-restricted by the switching pins 23, 25 are balanced, the high oil pressure from the oil pressure supply passage 31 does not directly act on the hydraulic lash adjusters T1, T2, but a relatively low oil pressure is imposed on the hydraulic lash adjusters T1, T2. Accordingly, the hydraulic lash adjusters T1, T2 are presented from being operated undesirably in error under high oil pressure which would otherwise be applied.

With the present invention, as described above, with respect to this second embodiment, the cam followers associated with the hydraulic lash adjusters have oil passages joining the oil pressure supply passage and th hydraulic lash adjusters, and the switching pins of the selective coupling mechanism are disposed across the oil passages in the cam followers. The switching pins can restrict the oil passages when the switching pins are moved from the cam follower connecting position. Therefore, when the selective coupling mechanism is operated to connect the cam followers under high oil pressure supplied to the oil pressure supply passage, the oil pressure to be supplied to the hydraulic lash adjusters is restricted to prevent high oil pressure from acting on the hydraulic lash adjusters. Consequently, the hydraulic lash adjusters are prevented from undesirable abnormal operation.

We claim:

1. A valve operating device for an internal combustion engine having a plurality of cam followers disposed adjacent to each other for valve operation in mutually different modes by cams on a camshaft dependent on engine speed, and a selective coupling mechanism disposed between the cam followers and having at least one switching pin movable in a guide hole in a cam follower between a connecting position in which the cam followers, are interconnected and a disconnecting position in which the cam followers are disconnected an improvement comprising an oil passage defined in at least one said cam follower and passing through said guide hole, and said switching pin having means for controlling the rate of flow of oil through said oil passage and past said guide hole in response to movement of th switching pin between said connecting and disconnecting positions.

2. A valve operating device according to claim 1, wherein said selective coupling mechanism is operable under oil pressure, said selective coupling mechanism and said oil passage being connected to a common oil pressure supply passage.

3. A valve operating device according to claim 1 or 2, wherein said oil passage comprises an oil passage for supplying lubricating oil to a surface of said one said cam follower which is slidable held against said camshaft.

4. A valve operating device according to claim 1 or 2, wherein each cam follower is provided with a separate oil passage, and a switching pin is provided in each cam follower for controlling the rate of flow of oil in the oil passage in that cam follower.

5. A valve operating device according to claim 4, wherein during high-speed engine operating a first said cam follower oil passage has the rate of flow of oil restricted by a switching pin therein and a second said cam follower oil passage has the rate of flow of oil unrestricted by a switching pin therein.

6. A valve operating device according to claim 5, wherein a third said cam follower oil passage has the rate of flow of oil restricted by a switching pin therein.

7. A valve operating device according to claim 1 or 2, wherein said one said cam follower has a guide hole slidably receiving a switching pin and an annular recess in said guide hole in communication with said oil passage in said one said cam follower, said switching pin having an annular groove positioned in registry with said annular recess for unrestricted oil flow through said oil passage, and said switching pin movable to a position with said annular groove out of registry with said annular recess for restricting oil flow through said oil passage.

8. A valve operating device according to claim 1 or 2, wherein said one said cam follower is provided with a hydraulic valve lash adjuster connected to the oil passage for controlling the oil supply to the lash adjuster by movement of said switching pin.

9. A valve operating device according to claim 8, wherein said switching pin is moved to a position for restricting the rate of flow of oil to the lash adjuster when a high oil supply pressure is provided to said selective coupling mechanism.

10. A valve operating device for an internal combustion engine having a plurality of cam followers including a cam follower having a hydraulic lash adjuster held against an intake or exhaust valve, said plurality of cam followers being disposed adjacent to each other for operation in mutually different modes by cams on a camshaft dependent on speed of rotation of the camshaft, a selective coupling mechanism disposed between the cam followers and having a switching pin movable under oil pressure between a connecting position in which the cam followers are interconnected and a disconnecting position in which the cam followers are disconnected, and a common oil pressure supply passage connected to the hydraulic lash adjuster and the selective coupling mechanism, an improvement comprising, an oil passage defined in the cam follower with the hydraulic lash adjuster with said oil passage joining the oil pressure supply passage and the hydraulic lash adjuster, said switching pin being disposed in the cam follower across said oil passage and capable of restricting said oil passage when the switching pin is moved from the disconnecting position to the connecting position.

11. A valve operating device according to claim 10 wherein said switching pin moves from the disconnecting position to the connecting position in response to high oil pressure being supplied through said common oil pressure supply passage.

12. A valve operating device for an internal combustion engine having a plurality of cam followers disposed adjacent to each other for valve operation in mutually different moves by cams on a camshaft dependent on engine speed, and a selective coupling mechanism disposed between the cam followers and having at least one switching pin movable between a connecting position in which the cam followers are interconnected and a disconnecting position in which the cam followers are disconnected, an improvement comprising an oil passage defined in at least one said cam follower, said switching pin having means for controlling the rate of flow of oil in said oil passage in responds to movement of the switching pin between said connecting and disconnecting positions, and wherein said oil passage comprises an oil passage for supplying lubricating oil to a surface of said one said cam follower which is slidable held against said camshaft.

13. A valve operating device for an internal combustion engine having a plurality of cam followers disposed adjacent to each other for valve operation in mutually different modes by cams on a camshaft dependent on engine speed, and a selective coupling mechanism disposed between the cam followers and having at least one switching pin movable between a connecting position in which the cam followers are interconnected and a disconnecting position in which the cam followers are disconnected, and improvement comprising an oil passage defined in at least one said cam follower, said switching pin having means for controlling the rate of flow of oil in said oil passage in response to movement of the switching pin between said connecting and disconnecting positions, and wherein each cam follower is provided with a separate oil passage, and a switching pin is provided in each cam follower for controlling the rate of flow of oil in the oil passage in that cam follower.

14. A valve operating device according to claim 13, wherein during high-speed engine operating a first said cam follower oil passage has the rate of flow of oil restricted by a switching pin therein and a second said cam follower oil passage has the rate of flow of oil unrestricted by a switching pin therein.

15. A valve operating device for an internal combustion engine having a plurality of cam followers disposed adjacent to each other for valve operation in mutually different modes by cams on a camshaft dependent on engine speed, and a selective coupling mechanism disposed between the cam followers and having at least one switching pin movable between a connecting position in which the cam followers are interconnected and a disconnecting position in which the cam followers are disconnected, an improvement comprising an oil passage defined in at least one said cam follower, said switching pin having means for controlling the rate of flow of oil in said oil passage in response to movement of the switching pin between said connecting and disconnecting positions and, wherein said one said cam follower has a guide hole slidably receiving a switching pin and an annular recess in said guide hole is communication with said oil passage in said one said cam follower, said switching pin having an annular groove positioned in registry with said annular recess for unrestricted oil flow through said oil passage, and said switching pin movable to a position with said annular groove out of registry with said annular recess for restricting oil flow through said oil passage.

16. A valve operating device according to claim 15, wherein each cam follower is provided with a separate oil passage, and a switching pin is provided in each cam follower for controlling the rate of flow of oil in the oil passage in that can follower.

17. A valve operating device for an internal combustion engine having a plurality of cam followers disposed adjacent to each other of valve operation in mutually different modes b cams on a camshaft dependent on engine speed, and a selective coupling mechanism disposed between the cam followers and having at least one switching pin movable between a connecting position in which the cam followers are interconnected and disconnecting position in which the cam followers are disconnected, an improvement comprising an oil passage defined in at least one said cam follower, and said switching pin having means for controlling the rate of flow of oil in said oil passage in response to movement of the switching pin between said connecting and disconnecting position, and wherein said one said cam follower is provided with a hydraulic valve lash adjuster connected to the oil passage for controlling the oil supply to the lash adjuster by movement of said switching pin.

18. A valve operating device according to claim 17, wherein said switching pin is moved to a position for restricting the rate of flow of oil to the lash adjuster when a high oil supply pressure is provided to said selective coupling mechanism.

19. A valve operating device according to claims 12,13, 14, 15, 16,17 or 18, wherein said selective coupling mechanism s operable under oil pressure and said selective coupling mechanism and said oil passage are connected to a common oil pressure supply passage.

* * * * *